US005422234A

United States Patent [19]

Bauer et al.

[11] Patent Number: 5,422,234

[45] Date of Patent: Jun. 6, 1995

[54] THERMALLY PROCESSABLE IMAGING ELEMENT INCLUDING AN ADHESIVE INTERLAYER COMPRISING A POLYMER HAVING EPOXY FUNCTIONALITY

[75] Inventors: Charles L. Bauer, Webster; Wayne A. Bowman, Walworth, both of N.Y.

[73] Assignee: Eastman Kodak Company, Rochester, N.Y.

[21] Appl. No.: 213,496

[22] Filed: Mar. 16, 1994

[51] Int. Cl.[6] ..... G03C 1/85

[52] U.S. Cl. ..... 430/527; 430/536; 430/523; 430/531; 430/534; 430/617; 430/619; 430/964; 430/961

[58] Field of Search ..... 430/536, 523, 531, 534, 430/617, 619, 964, 961, 527

[56] References Cited

U.S. PATENT DOCUMENTS

| | | | |
|---|---|---|---|
| 4,429,039 | 1/1984 | Ochiai | 430/523 |
| 4,452,883 | 6/1984 | Frenchik et al. | 430/502 |
| 4,741,992 | 5/1988 | Przezdziecki | 430/523 |
| 4,828,971 | 5/1989 | Przezdziecki | 430/531 |
| 4,886,739 | 12/1989 | Przezdziecki | 430/617 |
| 4,942,115 | 7/1990 | Przezdiecki | 430/523 |
| 4,999,276 | 3/1991 | Kuwabara et al. | 430/527 |
| 5,254,448 | 10/1993 | Yamada et al. | 430/523 |
| 5,264,334 | 11/1993 | Przezdziecki et al. | 430/523 |
| 5,275,927 | 1/1994 | Pham et al. | 430/536 |
| 5,294,526 | 3/1994 | Przezdiecki | 430/536 |

OTHER PUBLICATIONS

Carpenter and Lauf, Research Disclosure, Jun. 1978, Item 17029, pp. 9–15, Kenneth Mason Publications Ltd.

*Primary Examiner*—Thomas R. Neville
*Attorney, Agent, or Firm*—Alfred P. Lorenzo

[57] ABSTRACT

Thermally processable imaging elements in which the image is formed by imagewise heating or by imagewise exposure to light followed by uniform heating include an adhesive interlayer interposed between the imaging layer and a protective overcoat layer. The adhesive interlayer, which is comprised of a polymer having epoxy functionality, strongly bonds the overcoat layer to the imaging layer.

16 Claims, No Drawings

THERMALLY PROCESSABLE IMAGING ELEMENT INCLUDING AN ADHESIVE INTERLAYER COMPRISING A POLYMER HAVING EPOXY FUNCTIONALITY

CROSS-REFERENCE TO RELATED APPLICATIONS

Thermally processable imaging elements which include a thermographic or photothermographic layer, a protective overcoat layer and an adhesive interlayer, comprising a polyalkoxysilane, interposed between the overcoat layer and the thermographic or photothermographic layer are disclosed and claimed in copending commonly assigned U.S. patent application Ser. No. 213,778, filed Mar. 16, 1994, "Thermally Processable Imaging Element Including An Adhesive Interlayer Comprising A Polyalkoxysilane" by Charles L. Bauer and Wayne A. Bowman.

Thermally processable imaging elements which include a thermographic or photothermographic layer, a protective overcoat layer and an adhesive interlayer, comprising a polymer having pyrrolidone functionality, interposed between the overcoat layer and the thermographic or photothermographic layer are disclosed and claimed in copending commonly assigned U.S. patent application Ser. No. 213,784, filed Mar. 16, 1994, "Thermally Processable Imaging Element Including An Adhesive Interlayer Comprising A Polymer Having Pyrrolidone Functionality" by Charles L. Bauer and Wayne A. Bowman.

FIELD OF THE INVENTION

This invention relates in general to imaging elements and in particular to thermally processable imaging elements. More specifically, this invention relates to imaging elements comprising a thermographic or photothermographic layer, an overcoat layer and an adhesive interlayer interposed between the overcoat layer and the thermographic or photothermographic layer.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure*, June 1978,Item No. 17029 and U.S. Pat. No. 3,080,254, 3,457,075 and 3,933,508.

An important feature of the aforesaid thermally processable imaging elements is a protective overcoat layer. To be fully acceptable, a protective overcoat layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, and (e) be free from cracking and undesired marking, such as abrasion marking, during manufacture, storage, and processing of the element.

A particularly preferred overcoat for thermally processable imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid). The combination of poly(silicic acid) and a water-soluble hydroxyl-containing monomer or polymer that is compatible with the poly(silicic acid) is also useful in a backing layer on the side of the support opposite to the imaging layer as described in U.S. Pat. No. 4,828,971, issued May 9, 1989.

One of the most difficult problems involved in the manufacture of thermally processable imaging elements is that the protective overcoat layer typically does not exhibit adequate adhesion to the imaging layer. The problem of achieving adequate adhesion is particularly aggravated by the fact that the imaging layer is typically hydrophobic while the overcoat layer is typically hydrophilic. One solution to this problem is that described in U.S. Pat. No. 4,886,739, issued Dec. 12, 1989, in which a polyalkoxysilane is added to the thermographic or photothermographic imaging composition and is hydrolyzed in situ to form an $Si(OH)_4$ moiety which has the ability to crosslink with binders present in the imaging layer and the overcoat layer. Another solution to the problem is that described in U.S. Pat. No. 4,942,115, issued Jul. 17, 1990, in which an adhesion-promoting layer composed of certain adhesion-promoting terpolymers is interposed between the imaging layer and the overcoat layer.

The known solutions to the problem of providing adequate overcoat adhesion with thermally processable elements exhibit certain disadvantages which have hindered their commercial utilization. For example, while incorporation of a polyalkoxysilane in the imaging composition brings about a gradual increase in adhesion on aging of the element, the in situ hydrolysis of the polyalkoxysilane is slow and its rate is limited by the availability of water in the coated layer. Moreover, the alcohol which is formed as a by-product of the hydrolysis, for example, the ethyl alcohol that is formed by hydrolysis of tetraethoxysilane, is unable to escape through the highly impermeable overcoat layer and tends to migrate into the support. The support is typically a polyester, most usually poly(ethylene terephthalate), and migration of the alcohol into such a support causes a highly undesirable width-wise curl which makes the imaging element very difficult to handle. A serious consequence of such width-wise curl, even though it may be very slight in extent, is jamming of processing equipment.

The problem of unwanted curl can be reduced by use of the adhesion-promoting interlayer of U.S. Pat. No. 4,942,115, but use of this interlayer can result in adverse sensitometric effects, requires an additional coating step which makes it economically less attractive, and requires the use of terpolymers which are costly, difficult to handle and environmentally disadvantageous.

Unwanted curl can be reduced by use of a barrier layer which is comprised of poly(silicic acid) and a water-soluble hydroxyl-containing monomer or polymer that is compatible therewith and which is interposed between the support and the image-forming layer,as described in U.S. Pat. No. 5,264,334, issued Nov. 23, 1993. However, this method also requires the use of an additional coating step.

Unwanted curl can also be reduced by incorporating a pre-hydrolyzed polyalkoxysilane in the imaging composition as described in copending commonly-assigned U.S. patent application Ser. No. 020,911, filed Feb. 22,1993, "Method For The Manufacture Of A Thermally Processable Imaging Element" by Wojciech M. Przezdziecki and Jean Z. DeRuyter which issued as U.S. Pat. No. 5,310,640 on May 10, 1994. By utilizing a pre-hydrolyzed polyalkoxysilane, the byproducts of hydrolysis, such as the ethyl alcohol that is formed by hydrolysis of tetraethoxysilane, are not present in the image-forming layer and thus the problems caused by their migrating into the support are avoided. However, this method requires very exacting control of all process parameters.

It is toward the objective of providing an improved thermally processable imaging element having an adhesion-promoting-interlayer which overcomes the disadvantages of the prior art that the present invention is directed.

SUMMARY OF THE INVENTION

In accordance with this invention, a thermally processable imaging element is comprised of:

(1) a support;

(2) a thermographic or photothermographic imaging layer;

(3) an overcoat layer overlying the imaging layer; and (4) an adhesive-interlayer bonding the overcoat layer to the imaging layer; the adhesive interlayer comprising a polymer having epoxy functionality.

An adhesive interlayer comprising a polymer having epoxy functionality has been found to serve as an effective adhesion-promoting layer which overcomes the difficult problem of providing good adhesion between an overcoat which is typically hydrophilic and an imaging layer which is typically hydrophobic. Moreover, use of a polymer having epoxy functionality for this purpose not only provides very effective adhesion but causes no adverse sensitometric effects and involves the use of low cost, readily-available materials which are easily handled and coated and are environmentally advantageous.

The overcoat layer utilized in the thermally processable imaging elements of this invention performs several important functions as hereinabove described. It can be composed of hydrophilic colloids such as gelatin or poly(vinyl alcohol) but is preferably composed of poly(silicic acid) and a water-soluble hydroxyl-containing monomer or polymer as described in U.S. Pat. No. 4,741,992, issued May 3, 1988.

In addition to the support, the imaging layer, the overcoat layer and the adhesive interlayer, the thermally processable imaging element of this invention can optionally include additional layers such as a backing layer. Particularly useful backing layers are those comprising poly(silicic acid) and a water-soluble hydroxyl-containing monomer or polymer that is compatible therewith as described in U.S. Pat. No. 4,828,971, issued May 9, 1989. Thus, the improved thermally processable imaging element of this invention can contain three different layers each of which is comprised of poly(silicic acid), namely, (1) an overcoat layer whose purpose is to protect the element as described in U.S. Pat. No. 4,741,992, (2) a backing layer whose purpose is to improve conveyance, reduce static electricity and eliminate formation of Newton Rings as described in U.S. Pat. No. 4,828,971 and (3) a barrier layer whose purpose is to protect the support against migration from the imaging layer of hydrolysis by-products and thereby prevent width-wise curl as described in U.S. Pat. No. 5,264, 334.

In a preferred embodiment, the thermally processable imaging elements of this invention also include an electroconductive layer to provide antistatic protection as described in copending commonly assigned U.S. patent application Ser. No. 071, 806, filed Jun. 2, 1993, "Thermally Processable Imaging Element Comprising An Electroconductive Layer And A Backing Layer" by L. Jeffrey Markin, Diane E. Kestner, Wojciech M. Przezdziecki and Peter J. Cowdery-Corvan which issued as U.S. Pat. No. 5,310,640 on May 10, 1994.

DESCRIPTION OF THE PREFERRED EMBODIMENTS

The thermally processable imaging element of this invention can be a black-and-white imaging element or a dye-forming imaging element. It can be of widely varying construction as long as it includes the aforesaid support, imaging layer, overcoat layer and adhesive interlayer.

Typical imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure*, June 1978, Item No. 17029.

Polymers having epoxy functionality that are useful in this invention can vary widely in structure and include homopolymers of epoxy monomers, copolymers formed by polymerizing two polymerizable monomers one of which provides epoxy functionality and interpolymers formed by polymerizing three or more polymerizable monomers at least one of which provides epoxy functionality.

Polyalkoxysilanes can be utilized in the thermally processable imaging elements of this invention to form overcoat layers, backing layers or barrier layers or as components of the imaging layer. Polyalkoxysilanes useful for these purposes include those represented by the formulae I or II as follows:

$$Si(OR_1)_4 \qquad \text{I}$$

$$R_2—Si(OR_3)_3 \qquad \text{II}$$

wherein $R_1$ and $R_3$ are individually unsubstituted or substituted alkyl containing 1 to 4 carbon atoms, such as methyl, ethyl, propyl and butyl, and $R_2$ is unsubstituted or substituted alkyl, such as alkyl containing 1 to 22 carbon atoms, such as methyl, ethyl, propyl, butyl, and n-octadecyl; or unsubstituted or substituted phenyl.

Specific examples of useful polyalkoxysilanes for the aforesaid purposes include:

$Si(OC_2H_5)_4$ $Si(OCH_3)_4$
$CH_3Si(OC_2H_5)_3$
$CH_3Si(OCH_3)_3$
$C_6H_5Si(OC_2H_5)_3$
$C_6H_5Si(OCH_3)_3$
$NH_2CH_2CH_2CH_2Si(OC_2H_5)_3$
$NH_2CH_2CH_2CH_2Si(OCH_3)_3$

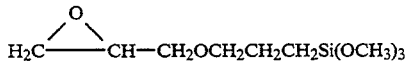

and
$CH_3(CH_2)_{17}Si(OC_2H_5)3$.

The optimum layer thickness of the imaging layer, the overcoat layer and the adhesive interlayer depends upon various factors, such as the particular element, processing conditions, thermal processing means, desired image and the particular components of the layers. A particularly useful imaging layer thickness is typically within the range of 1 to 10 microns, preferably 3 to 7 microns. A particularly useful overcoat layer thickness is also typically within the range of 1 to 10 microns, preferably 1 to 3 microns. A particularly useful adhesive interlayer thickness is typically within the range of about 0.008 to about 0.05 microns, preferably 0.01 to 0.02 microns.

Useful overcoat compositions are typically transparent and colorless. If the overcoat is not transparent and colorless, then it is necessary, if the element is a photothermographic element, that it be at least transparent to the wavelength of radiation employed to provide and view the image. The overcoat does not significantly adversely affect the imaging properties of the element, such as the sensitometric properties in the case of a photothermographic element, such as minimum density, maximum density, or photographic speed.

The overcoat composition preferably comprises 50 to 90% by weight of the overcoat of poly(silicic acid) and comprises a water-soluble hydroxyl-containing polymer or monomer that is compatible with the poly(silicic acid). Such an overcoat composition is described in, for example, U.S. Pat. No. 4,741,992. Examples of water soluble hydroxyl-containing polymers are acrylamide polymers, water-soluble cellulose derivatives, hydroxy ethyl cellulose, water-soluble cellulose acetate, and poly(vinyl alcohol). Partially hydrolyzed poly(vinyl alcohols) are preferred.

Thermally processable imaging elements as described can contain multiple polymer-containing layers, such as multiple overcoat layers. For example, the thermally processable imaging element can contain a first overcoat layer comprising a polymer other than poly(silicic acid), such as a cellulose derivative, and a second overcoat layer comprising poly(silicic acid) and poly(vinyl alcohol).

A preferred overcoat comprises 50 to 90% by weight of poly(silicic acid) represented by the formula:

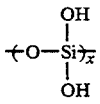

wherein x is an integer within the range of at least 3 to about 600 and wherein the overcoat also comprises 10 to 50% poly(vinyl alcohol).

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure*, December 1978, Item No. 17029 and *Research Disclosure*, June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0. 1 to 100 moles of organic silver salt oxidizing agent per mole of silver in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029. Combinations of organic reducing agents are also useful in the photothermographic element.

Preferred organic reducing agents in the photothermographic element are sulfonamidophenol reducing agents, such as described in U. S. Pat. No. 3,801,381. Examples of useful sulfonamidophenol reducing agents are 2, 6-dichloro-4-benzenesulfonamidophenol; benzenesulfonamidophenol; and 2, 6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, phthalimide, N-hydroxyphthalimide, N-potassiumphthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The thermally processable element can comprise a variety of supports. Examples of useful supports are poly(vinylacetal) film, polystyrene film, poly(ethyleneterephthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis(tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 130° C.

In the case of a thermographic element, the thermal energy source and means for imaging can be any image-wise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in more than one layer of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

The thermally processable imaging element of this invention preferably includes a backing layer. The backing layer utilized in this invention is an outermost layer and is located on the side of the support opposite to the imaging layer. It is typically comprised of a binder and a matting agent which is dispersed in the binder in an amount sufficient to provide the desired surface roughness.

A wide variety of materials can be used to prepare a backing layer that is compatible with the requirements of thermally processable imaging elements. The backing layer should be transparent and colorless and should not adversely affect sensitometric characteristics of the photothermographic element such as minimum density, maximum density and photographic speed. Preferred backing layers are those comprised of poly(silicic acid) and a water-soluble hydroxyl containing monomer or polymer that is compatible with poly(silicic acid) as described in U.S. Pat. No. 4,828,971. A combination of poly(silicic acid) and poly(vinyl alcohol) is particularly useful. Other useful backing layers include those formed from polymethylmethacrylate, cellulose acetate, crosslinked polyvinyl alcohol, terpolymers of acrylonitrile, vinylidene chloride, and 2-(methacryloyloxy)ethyltrimethylammonium methosulfate, crosslinked gelatin, polyesters and polyurethanes.

In the thermally processable imaging elements of this invention, either organic or inorganic matting agents can be used. Examples of organic matting agents are particles, often in the form of beads, of polymers such as polymeric esters of acrylic and methacrylic acid, e.g., poly(methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The backing layer preferably has a glass transition temperature (Tg) of greater than 50° C., more preferably greater than 100° C., and a surface roughness such that the Roughness Average (Ra) value is greater than 0.8, more preferably greater than 1.2, and most preferably greater than 1.5.

As described in U.S. Pat. No. 4,828,971, the Roughness Average (Ra) is the arithmetic average of all departures of the roughness profile from the mean line.

The concentration of matting agent required to give the desired roughness depends on the mean diameter of the particles and the amount of binder. Preferred particles are those with a mean diameter of from about 1 to about 15 micrometers, preferably from 2 to 8 micrometers. The matte particles can be usefully employed at a concentration of about 1 to about 100 milligrams per square meter.

In order to improve image tone, improve printout, provide better visual contrast and enhance the appearance of the thermally processable imaging elements of this invention, a small amount of a colorant can be added to the overcoat layer and/or adhesive interlayer. Blue colorants, such as Victoria Pure Blue BO, Victoria Brilliant Blue G, Serva Blue WS, Aniline Blue, Page Blue G-90 and Methylene Blue, are especially useful for this purpose.

In a preferred embodiment of this invention, the thermally processable imaging element also includes an electroconductive layer to serve as an antistatic layer. For this purpose, the electroconductive layer should have an internal resistivity of less than $5\times10^{10}$ ohms/square. Such electroconductive layers are described in copending commonly assigned U.S. patent application Ser. No. 071,806, filed Jun. 2,1993,"Thermally Processable Imaging Element Comprising An Electroconductive Layer And A Backing Layer" by L. Jeffrey Markin, Diane E. Kestner, Wojciech M. Przezdziecki and Peter J. Cowdery-Corvan.

The electroconductive layer utilized in this invention in accordance with the teachings of the aforesaid patent application Ser. No. 071,806 is an "inner layer", i.e., a layer located under one or more overlying layers. It can be disposed on either side of the support. As indicated hereinabove, it has an internal resistivity of less than $5\times10^{10}$ ohms/square. Preferably, the internal resistivity of the electroconductive layer is less than $1\times10^{10}$ ohms/square.

The electroconductive layer can be composed of any of a very wide variety of compositions which are capable of forming a layer with suitable physical and electrical properties to be compatible with the requirements of thermally processable imaging elements. Included among the useful electroconductive layers are:

(1) Electroconductive layers comprised of electrically-conductive metal-containing particles dispersed in a polymeric binder. Examples of useful electrically-conductive metal-containing particles include donor-doped metal oxide, metal oxides containing oxygen deficiencies and conductive nitrides, carbides or borides. Specific examples of particularly useful particles include conductive $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN and ZrC.

Examples of the many patents describing electrically-conductive metal-containing particles that are useful in this invention include:

(a) semiconductive metal salts such as cuprous iodide as described in U.S. Pat. Nos. 3,245, 833, 3,428,451 and 5,075,171;

(b) metal oxides, preferably antimony-doped tin oxide, aluminum-doped zinc oxide and niobium-doped titanium oxide as described in U.S. Pat. No. 4,275,103, 4,394,441, 4,416,963, 4,418,141, 4,431,764, 4,495,276, 4,571,361, 4,999,276 and 5,122,445;

(c) a colloidal gel of vanadium pentoxide as described in U.S. Pat. Nos. 4,203,769 and 5,006,451;

(d) fibrous conductive powders comprising, for example, antimony-doped tin oxide coated onto non-conductive potassium titanate whiskers as described in U.S. Pat. Nos. 4,845,369 and 5,116,666;

(e) electroconductive ceramic particles, such as particles of TiN, $NbB_2$, TiC, $LaB_6$ or MoB dispersed in a binder as described in Japanese KOKAI NO. 4/55492, published Feb. 24, 1992;

(2) Electroconductive layers composed of a vapor-deposited metal such as silver, aluminum or nickel;

(3) Electroconductive layers composed of binderless electrically-semiconductive metal oxide thin films formed by oxidation of vapor-deposited metal films as described in U.S. Pat. No. 4, 078, 935.

(4) Electroconductive layers composed of conductive polymers such as, for example, the cross-linked vinylbenzyl quaternary ammonium polymers of U.S. Pat. No. 4,070,189 or the conductive polyanilines of U.S. Pat. No. 4,237,194.

A colloidal gel of vanadium pentoxide is especially useful for forming the electroconductive layer. When vanadium pentoxide is used for this purpose, it is desirable to interpose a barrier layer between the electroconductive layer and the imaging layer so as to inhibit migration of vanadium pentoxide from the electroconductive layer into the imaging layer with resulting adverse sensitometric affects. Suitable barrier layers include those having the same composition as the backing layer of U.S. Pat. No. 4,828,971, namely, a mixture of poly(silicic acid) and a water-soluble hydroxyl-containing monomer or polymer.

Use in this invention of a colloidal gel of vanadium pentoxide, the preparation of which is described in U.S. Pat. No. 4,203,769, issued May 20, 1980, has many important beneficial advantages. The colloidal vanadium pentoxide gel typically consists of entangled, high aspect ratio, flat ribbons about 50–100 angstroms wide, about 10 angstroms thick and about 1000–10000 angstroms long. The ribbons stack flat in the direction parallel to the surface when the gel is coated to form a conductive layer. The result is very high electrical conductivities which are typically about three orders of magnitude greater than is observed for layers of similar thickness containing crystalline vanadium pentoxide particles. Low surface resistivities can be obtained with very low vanadium pentoxide coverages. This results in low optical absorption and scattering losses. Also, the coating containing the colloidal vanadium pentoxide gel is highly adherent to underlying support materials.

As hereinabove described, the improved thermally processable imaging element of this invention includes an adhesive interlayer interposed between the imaging layer and the overcoat layer, which comprises a polymer having epoxy functionality. The purpose of the adhesive interlayer is to strongly bond the overcoat layer to the imaging layer so that it cannot be easily removed. By the term "epoxy functionality" is meant the presence of one or more pendant oxirane rings. Preferably, the polymer is comprised of recurring units of which at least 50 mole percent comprise a pendant oxirane ring.

Polymers having epoxy functionality which are preferred for use in this invention are comprised of recurring units represented by the formula:

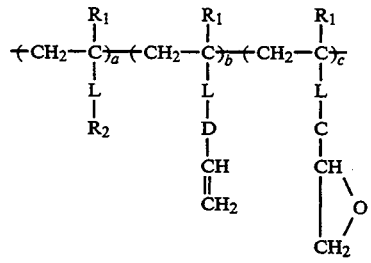

wherein:

$R_1$ is hydrogen or methyl, $R_2$ is alkyl of 1 to 8 carbon atoms or cycloalkyl of 3 to 8 carbon atoms, D is alkylene of 1 to 6 carbon atoms,

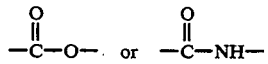

a=30–70 mole %, b=0–10 mole %, c=20–70 mole %.

The above-described polymers having epoxy functionality are readily prepared by reacting a polymerizable epoxy compound with one or more polymerizable acrylic monomers.

Examples of suitable polymerizable acrylic monomers include:

ethyl acrylate
ethyl methacrylate
butyl acrylate
butyl methacrylate
cyclohexyl acrylate
cyclohexyl methacrylate
styrene
methyl acrylate
lauryl acrylate
lauryl methacrylate
allyl methacrylate
and the like Examples of suitable polymerizable epoxy monomers include:

glycidyl methacrylate
glycidyl acrylate
allyl glycidyl ether.

Specific examples of polymers having epoxy functionality that are preferred for use in this invention include:

poly(butyl acrylate-co-allyl methacrylate-co-glycidyl methacrylate)

poly(butyl methacrylate-co-allyl methacrylate-co-glycidyl methacrylate)

poly(butyl acrylate-co-glycidyl methacrylate)

poly(lauryl methacrylate-co-allyl methacrylate-co-glycidyl methacrylate)

In a particularly preferred embodiment of the invention, the overcoat layer comprises polysilicic acid and polyvinylalcohol, the imaging layer comprises polyvinylbutyral, and the adhesive interlayer is comprised of poly(butyl acrylate-co-allyl methacrylate-co-glycidyl methacrylate).

The use of a polymer having epoxy functionality in the adhesive interlayer is highly advantageous in comparison with the prior art. Thus, for example, U.S. Pat. No. 4,942,115 describes the use of an adhesive interlayer comprising a terpolymer such as poly(2-propenenitrile-co-1,1-dichloroethene-co-2-propenoic acid) or poly(2-propenoic acid methyl ester-co-1,1-dichloroethene-co-itaconic acid). These terpolymers are very effective in providing good adhesion but are costly, difficult to handle and environmentally disadvantageous and can cause adverse sensitometric effects such as an undesirably high $D_{min}$.

The invention is further illustrated by the following example of its practice.

A thermally processable imaging element was prepared by coating a poly(ethylene terephthalate) film support, having a thickness of 0.114 millimeters, with a photothermographic imaging layer, an adhesive interlayer and a protective overcoat layer. The photothermographic imaging composition was coated from a solvent mixture containing 90 parts by weight methyl isobutyl ketone and 10 parts by weight acetone to form an imaging layer of the following composition.

| Component | Coverage ($g/m^2$) |
|---|---|
| Silver behenate | 0.952 |
| AgBr | 0.388 |
| Succinimide | 0.428 |
| *Surfactant | 0.018 |
| 2-Bromo-2-p-tolylsulfonyl acetamide | 0.070 |
| 2,4-Bis(trichloromethyl)-6-(1-naphtho)-S-triazine | 0.017 |
| Sensitizing dye | 0.005 |
| 4-Benzenesulfonamidophenol | 1.132 |
| **Binder | 3.020 |

*A polysiloxane fluid available under the trademark SF-96 from General Electric Company.
**A poly(vinylbutyral) available under the trademark BUTVAR B-76 resin from Monsanto Company.

The adhesive interlayer consisted of poly(butyl acrylate-co-allyl methacrylate-co-glycidyl methacrylate) coated at a coverage of 0.11 $g/m^2$.

To prepare the protective overcoat layer, polysilicic acid was prepared by mixing 29.4 weight % water, 1.2 weight % one normal p-toluene sulfonic acid, 4 weight % methanol and 35.4 weight % tetraethoxysilane to form a 16.3 weight % polysilicic acid solution. The polysilic acid was mixed with polyvinyl alcohol, a surfactant, matte beads and water to form a protective overcoat layer of the following composition.

| Component | Coverage ($g/m^2$) |
|---|---|
| *Polyvinyl alcohol | 1.1 |
| Polysilicic acid | 1.65 |
| **Surfactant | 0.044 |

-continued

| Component | Coverage ($g/m^2$) |
|---|---|
| Polymethylmethacrylate beads | 0.055 |

*A high molecular weight polyvinyl alcohol available under the trademark Elvanol 52/22 from E. I. dupont deNemours and Company
**A para-isononylphenoxy polyglycidol surfactant available under the trademark Surfactant 10G from Olin Corporation.

A second thermally processable imaging element, identified as Control A, was prepared in the same manner as the element described above except that the adhesive interlayer was omitted.

A third thermally processable imaging element, identified as Control B, was prepared in the same manner as the element described above except that the poly(butyl acrylate-co-allyl methacrylate-co-glycidyl methacrylate) in the adhesive interlayer was replaced with poly(-butylacrylate-co-2-sulfo-1,1-dimethylethyl acrylamide-co-methyl-2-acrylamido-2-methoxyacetate).

For each of the elements of the example and Controls A and B, adhesion of the overcoat layer to the imaging layer was evaluated using a tape adhesion test. In carrying out the test, a 35-mm wide sample was prepared and laid flat on a table and a section of SCOTCH Magic Tape #811, available from Minnesota Mining and Manufacturing Company, was placed across the width of the sample and smoothed out by hand to assure uniform adhesion. Upon manually removing the tape, the percent of the overcoat layer removed was estimated and related to adhesion. Ideally, the extent of removal would be zero. The test was performed up to ten times for each sample. Measurements were made for fresh samples, for samples aged two weeks at ambient conditions, and for samples aged two weeks at 49° C./15% relative humidity.

The effect of the adhesive interlayer on sensitometry was determined by measuring the $D_{min}$ of each sample after exposure ($10^{-3}$ sec, EG & G, Wratten 29 filter) and heat processing for 5 seconds at 119° C. The lower the $D_{min}$ value the better the results. In each case, the $D_{min}$ was determined for a sample that had been aged two weeks at 49° C./15% relative humidity.

Results obtained in both the adhesion test and the sensitometry test are summarized in Table I below.

TABLE I

| | Percent of Overcoat Removed | | | |
|---|---|---|---|---|
| | Fresh | 2 Week Ambient | 2 Week 49° C./15% RH | $D_{min}$ |
| Example | 0 | 1.5 | 0 | 0.22 |
| Control A | 60 | 76 | 16.5 | 0.23 |
| Control B | 25 | 0 | 0 | 1.22 |

The data reported in Table I show that incorporation of an adhesive interlayer in accordance with this invention in the thermally processable element substantially improves the adhesion of the overcoat layer to the imaging layer and does so without adverse effects on $D_{min}$. In marked contrast, use of the adhesive interlayer employed in Control B improved adhesion but caused a highly undesirable increase in $D_{min}$.

The present invention provides an important improvement in thermally processable imaging elements. A hydrophilic overcoat layer, such as a layer containing poly(silicic acid) and poly(vinyl alcohol), provides excellent protection for such elements. However, the degree of adhesion of such an overcoat layer to hydrophobic imaging layers, such as those that contain poly(-vinyl butyral), is inadequate as a consequence of the general lack of comparability of hydrophiic and hydrophobic layers. The adhesive interlayer of this invention overcomes the problem of inadequate adhesion and does so with low cost readily-available materials which are easy to coat and handle, are environmentally advantageous and do not cause adverse sensitometric effects.

The invention has been described in detail, with particular reference to certain preferred embodiments thereof, but it should be understood that variations and modifications can be effected within the spirit and scope of the invention.

We claim:

1. A thermally processable imaging element, said element comprising:

(1) a support;

(2) a thermographic or photothermographic imaging layer;

(3) an overcoat layer overlying said imaging layer; and (4) an adhesive interlayer bonding said overcoat layer to said imaging layer; said adhesive interlayer comprising a polymer having epoxy functionality.

2. A thermally processable imaging element as claimed in claim 1 additionally comprising a backing layer on the side of said support opposite to said imaging layer.

3. A thermally processable imaging element as claimed in claim 1 additionally comprising an electroconductive layer which is an inner layer and is located on either side of said support; said electroconductive layer having an internal resistivity of less than $5\times10^{10}$ ohms/square.

4. A thermally processable imaging element as claimed in claim 1 wherein said support is a poly(ethylene terephthalate) film.

5. A thermally processable imaging element as claimed in claim 1 wherein said imaging layer comprises:

(a) photographic silver halide, (b) an image-forming combination comprising (i) an organic silver salt oxidizing agent, with (ii) a reducing agent for the organic silver salt oxidizing agent, and (c) a toning agent.

6. A thermally processable imaging element as claimed in claim 1 wherein said polymer having epoxy functionality is comprised of recurring units of which at least 50 mole percent comprise a pendant oxirane ring.

7. A thermally processable imaging element as claimed in claim 1, wherein said polymer having epoxy functionality is comprised of recurring units represented by the formula:

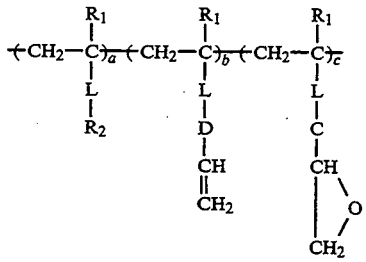

wherein:

$R_1$ is hydrogen or methyl, $R_2$ is alkyl of 1 to 8 carbon atoms or cycloalkyl of 3 to 8 carbon atoms, D is alkylene of 1 to 6 carbon atoms, L is

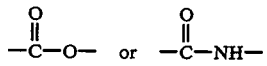

a=30–70 mole %, b=0–10 mole %, c=20–70 mole %.

8. A thermally processable imaging element as claimed in claim 1, wherein said polymer having epoxy functionality is poly(butyl acrylate-co-allyl methacrylate-co-glycidyl methacrylate).

9. A thermally processable imaging element as claimed in claim 1 wherein said overcoat layer is comprised of poly(silicic acid) and a water-soluble hydroxyl-containing monomer or polymer.

10. A thermally processable imaging element as claimed in claim 1 wherein said imaging layer comprises a poly(vinyl butyral) binder.

11. A thermally processable imaging element as claimed in claim 1 wherein said imaging layer comprises:

(a) photographic silver halide, (b) an image-forming combination comprising (i) silver behenate, with (ii) a phenolic reducing agent for the silver behenate, (c) a succinimide toning agent, and (d) an image stabilizer.

12. A thermally processable imaging element as claimed in claim 2, wherein said backing layer is comprised of a binder and a matting agent dispersed therein.

13. A thermally processable imaging element as claimed in claim 2, wherein said backing layer is comprised of poly(silicic acid) and a water-soluble hydroxyl-containing monomer or polymer.

14. A thermally processable imaging element as claimed in claim 3, wherein said electroconductive layer comprises a colloidal gel of vanadium pentoxide.

15. A thermally processable imaging element as claimed in claim 1, wherein said adhesive interlayer has a thickness in the range of from about 0.008 to about 0.05 microns.

16. A thermally processable imaging element, said element comprising a poly(ethylene terephthalate) film support having a backing layer, comprised of poly(silicic acid) and poly(vinyl alcohol), on one side thereof and having on the opposite side, in order, a photothermographic imaging layer comprising silver halide, silver behenate and poly(vinyl butyral), an adhesive interlayer comprising poly(butyl acrylate-co-allyl methacrylate-co-glycidyl methacrylate), and an overcoat layer comprised of poly(silicic acid) and poly(vinyl alcohol).

* * * * *